US008523601B2

(12) United States Patent
Stein

(10) Patent No.: US 8,523,601 B2
(45) Date of Patent: Sep. 3, 2013

(54) LINE RECEPTACLE DEVICE WITH STRAIN RELIEF

(75) Inventor: Ulf Stein, Amberg (DE)

(73) Assignee: Siemens Aktiengesellschaft, Muenchen (DE)

( * ) Notice: Subject to any disclaimer, the term of this patent is extended or adjusted under 35 U.S.C. 154(b) by 0 days.

(21) Appl. No.: 13/444,162

(22) Filed: Apr. 11, 2012

(65) Prior Publication Data

US 2012/0264324 A1 Oct. 18, 2012

(30) Foreign Application Priority Data

Apr. 12, 2011 (EP) ..... 11161989

(51) Int. Cl.
*H01R 13/58* (2006.01)

(52) U.S. Cl.
USPC ..... 439/455

(58) Field of Classification Search
USPC ..... 439/455, 453, 460, 469, 470, 472, 439/660, 676
See application file for complete search history.

(56) References Cited

U.S. PATENT DOCUMENTS

| | | | | |
|---|---|---|---|---|
| 4,840,581 | A | 6/1989 | Leufert et al. | |
| 5,839,911 | A | 11/1998 | Dinkel | |
| 5,967,830 | A * | 10/1999 | Tsuji | 439/470 |
| 6,478,609 | B1 * | 11/2002 | Davis et al. | 439/470 |
| 7,371,106 | B2 * | 5/2008 | Nad | 439/470 |
| 7,507,108 | B2 * | 3/2009 | Tsuji | 439/446 |
| 2012/0264324 | A1 * | 10/2012 | Stein | 439/345 |
| 2013/0072054 | A1 * | 3/2013 | Hotea et al. | 439/460 |

FOREIGN PATENT DOCUMENTS

| | | |
|---|---|---|
| DE | 101 51 455 | 5/2002 |
| EP | 0 345 189 | 12/1989 |
| WO | WO 2007/112771 | 10/2007 |

* cited by examiner

*Primary Examiner* — Tulsidas C Patel
*Assistant Examiner* — Phuongchi T Nguyen
(74) *Attorney, Agent, or Firm* — Cozen O'Connor

(57) ABSTRACT

A line receptacle device comprising a first housing part, a second housing part, an entry channel for a line and a strain relief device that is configured to move from a first position into a second position, and if configured such that, in the first position the line can be introduced through the entry channel and in the second position the line can be clamped into the entry channel, in which case the strain relief device also has a locking device which, on transition from the first position into the second position, interacts with a retaining device disposed in the first housing part and the second housing part such that the housing parts are locked together.

8 Claims, 3 Drawing Sheets

LINE RECEPTACLE DEVICE WITH STRAIN RELIEF

BACKGROUND OF THE INVENTION

1. Field of the Invention

The invention relates line receptacles and, more particularly, to a line receptacle device comprising a first housing part, a second housing part, an entry channel for a line and a strain relief device.

2. Description of the Related Art

Conventional line receptacle devices known, for example, as a plug housing with strain relief are generally known, such as the Schuko plug system. In conventional solutions for providing strain relief, the line receptacle devices use at least two separate screw fittings, a first screw fitting for strain relief of the line, and a second screw fitting that is needed to close off a housing of the line receptacle device. The use of at least two separate screw fitting mechanisms mean that increased time is required to install a cable or a line into such a line receptacle device.

SUMMARY OF THE INVENTION

It is an object of the present invention to improve conventional line receptacle devices to the extent that installation of such line receptacles is simplified and such that they require less time to install.

This and other objects and advantages are achieved in accordance with the invention by providing a line receptacle device comprising a first housing part, a second housing part, an entry channel for a line, a strain relief device, where the strain relief device is configured to be moved from a first position into a second position. The strain relief device is configured further such that in the first position the line can be introduced through the entry channel and in the second position the line can be clamped into the entry channel, in which case the strain relief device also has a locking device which, on transition from the first position into the second position, interacts with a retaining device arranged in the first housing part and the second housing part such that the housing parts are locked onto each other. In accordance with the invention, in the line receptacle device, the function for strain relief of the line and the function for closing off a housing are overlaid and thus the strain relief is established and the housing, for example, of a plug, is locked in one operation.

In an advantageous embodiment of the line receptacle device, the first housing part is connected pivotably to the second housing part to allow the two parts to be folded together into one housing. If the line has been introduced through the entry channel into the line receptacle device, then the first housing part can be hinged by a hinge mechanism onto the second housing part and, through actuation of a further mechanism, the strain relief device is moved from the first position into the second position, where the strain relief for the line is established almost simultaneously and the two housing parts are locked to one another to form a housing.

In a further embodiment, the locking device are configured as T-shaped catches and the retaining means as longitudinal slots with recesses at the first position. Here, the strain relief device has the locking device as a T-shaped catch and the housing parts each have a retaining device comprising longitudinal slots in the housing parts. In order, for example, to make it possible for the housing parts to be folded together when the strain relief device is located in the first position, the retaining device with its longitudinal slot has two recesses arranged transversely to the longitudinal slot which make it possible for the T-shaped catch to penetrate into the housing at the location of the recesses.

Preferably, the strain relief device has a threaded section through which a screw is passed. A screw can be used to bring the strain relief device from the first position into the second position, with the screw being screwed into the threaded section and by being turned, for example, in the clockwise direction, moving the strain relief device from the first position into the second position. In this movement, when the housing parts are folded together, the strain relief device is supported between the housing parts such that it is able to be moved transversely to a longitudinal axis of the entry channel.

In order to further simplify installation of a line into such a line receptacle device, the strain relief device is formed in the shape of a U. With this U-shaped embodiment, it is advantageous for the line to be able to be inserted into the opening of the U when the housing is opened, i.e., when the first and second housing part are folded out from one another.

To use the line receptacle device, for example, for plug systems in electrical installations, the line receptacle device has a receptacle for receiving a plug connector. For particularly supplying power to electrical devices, especially in process automation, the line receptacle device with its plug connector in accordance with the invention can be used as a connection plug for power supply modules of a modular automation system. This type of line receptacle device enables simple, rapid installation or dismantling and easier wiring work to be implemented. The movable strain relief device provides a further advantage in that a range of possible cross sections of lines or individual wires can be covered. For example, the U-shaped embodiment of the strain relief device allows strain relief to be safely provided for 3 individual leads each of 1.5 $mm^2$ up to an entire cable or a line with a total diameter of 9 mm.

After the three individual electrical leads are connected for example, the first housing part can be closed as a cover for example, and the screw is now turned in the clockwise direction until such time as an opposing torque signals to the installer that the strain relief has engaged. With this engagement of the strain relief, the first housing part has simultaneously been locked to the second housing part via the locking and retaining device.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The drawing shows an exemplary embodiment of a line receptacle device comprising a connection plug for power supply modules of an automation system, where FIGS. 1 to 6 are depicted in a perspective view, in which:

FIG. 1 is an assembly diagram of the line receptacle device with closed housing part in accordance with the invention;

FIG. 2 is an assembly diagram of the line receptacle device of FIG. 1 with a first housing part folded out;

FIG. 3 is an assembly diagram of the line receptacle device of FIG. 1 in an open state, where the first housing part is not shown in the drawing;

FIG. 4 is an assembly diagram of the strain relief device with a screw in accordance with the invention;

FIG. 5 is a cross-sectional assembly diagram of the line receptacle device of FIG. 1, where the section bisects the strain relief device that is located in a first position; and FIG. 6 is a cross-sectional assembly diagram of the line receptacle device of FIG. 1, where the strain relief device is located in a second position.

DETAILED DESCRIPTION OF THE PREFERRED EMBODIMENTS

Figure 1:
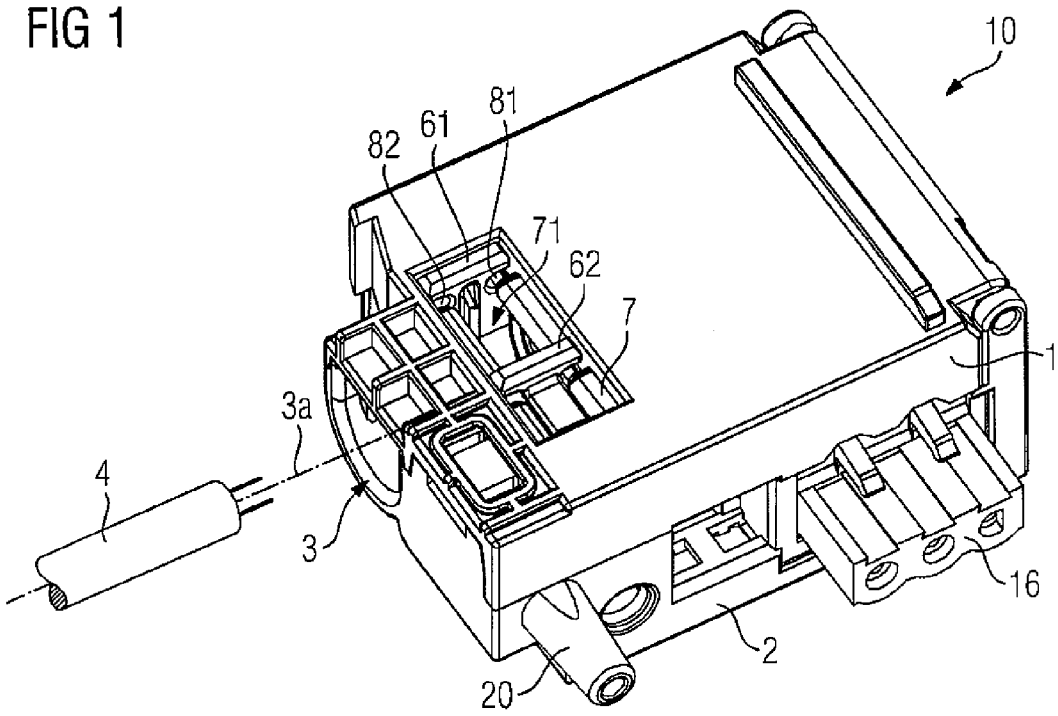

The diagram according to FIG. 1 shows a line receptacle device 10 comprising a connection plug for a power supply module of an automation system. The line receptacle device 10 comprises a first housing part 1, a second housing part 2, an entry channel 3 for a line 4 and a strain relief device 5, which is arranged to allow movement between the first housing part 1 and the second housing part 2. The first housing part 1 has a first longitudinal slot 71, whereby a first catch 61 which is configured in the shape of a T can penetrate transversely through a first recess 81 and a second recess 82 into the first longitudinal slot. The line 4 is introduced in parallel to a longitudinal axis 3*a* into the entry channel 3. A plug connector 16 with screw terminal connections is available for an electrical connection of individual leads.

Figure 2:
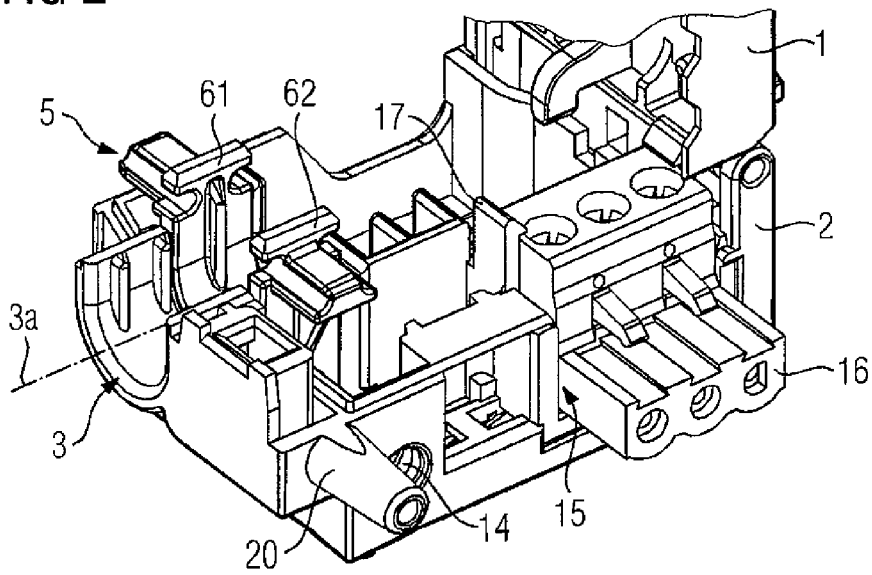

FIG. 2 shows the connection plug of FIG. 1 in a slightly perspectively modified diagram, with the first housing part 1 opened. The strain relief device 5 is formed is a U shape to lay the lead 4 into the strain relief device 5. A receptacle 15 allows the plug connector 16 to be plugged into the receptacle 15. A latching lug 17 ensures that, with the plug connector 16 plugged in, the connector remains in the receptacle 15. For secure plugging-in of the plug connector, for example, into a power supply module, the second housing part 2 ensures that when the plug connector 16 is plugged in, the connector remains in the receptacle. For the secure connection of the plug connector, into a power supply module, for example, the second housing part 2 has a guide pin 20.

Figure 3:
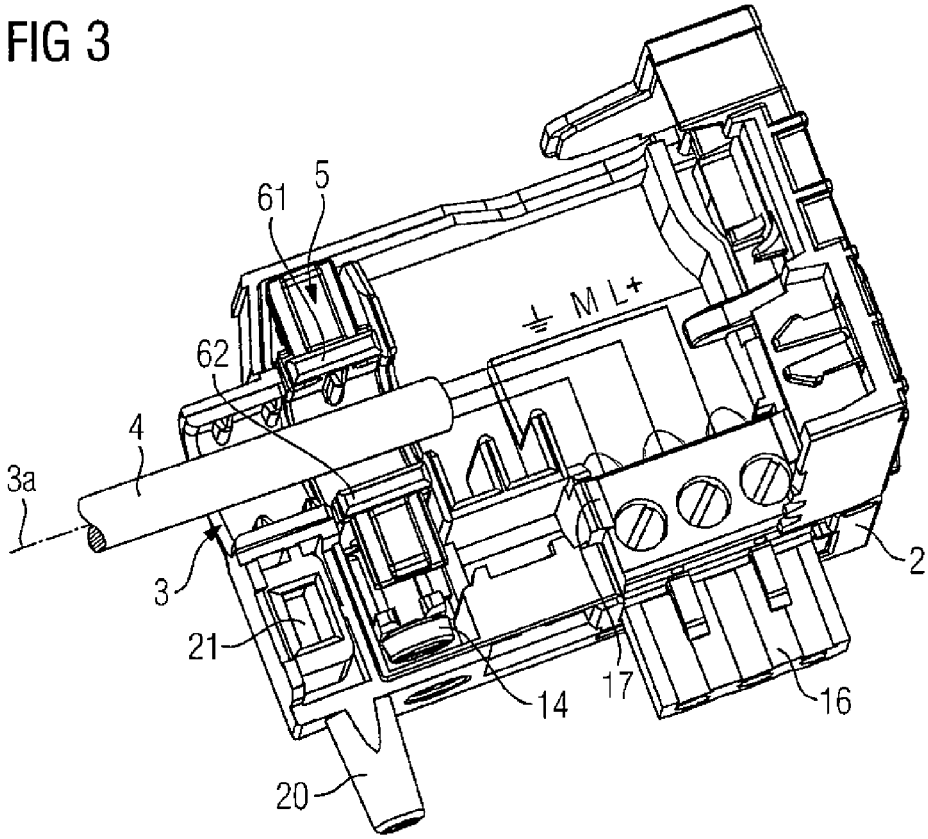

In accordance with FIG. 3, the first housing part 1 is shown in a perspective view from above. The inserted lead 4 has three individual wires, which are connected to an L+ terminal, an M terminal and a ground terminal. The strain relief device 5 is embedded into the first housing part 1 such that the strain relief device 5 can be moved transversely to the longitudinal axis 3*a* of the entry channel 3. An introduction cross-section of the entry channel 3 becomes smaller as the strain relief device 5 is moved and, by virtue of the introduction cross-section becoming smaller, the lead 4 can be clamped into the entry channel 3 by the movement of the strain relief device 5.

Figure 4:
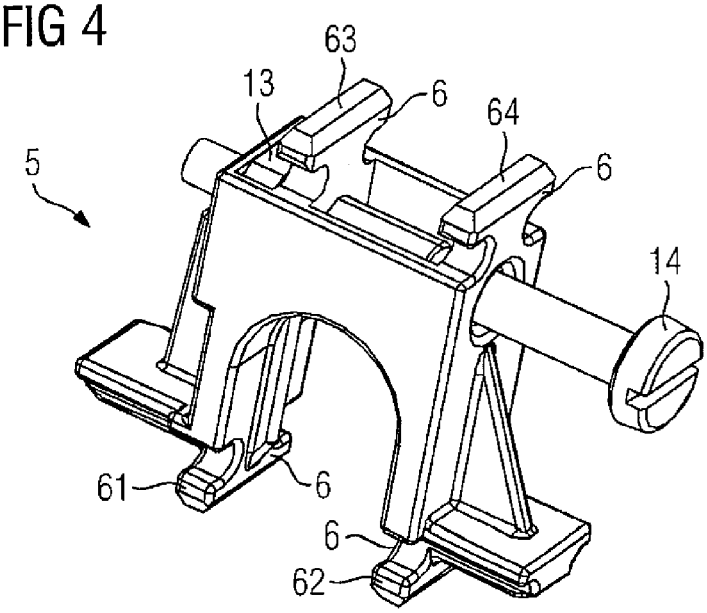

FIG. 4 shows the strain relief device 5 in a diagram on its own. For engagement and for interaction with the retaining device 7 in the housing parts 1, 2, the strain relief device 5 has a first catch 61, a second catch 62, a third catch 63 and a fourth catch 64, where each of these catches is formed in a T-shape. A threaded section 13 arranged in the strain relief device 5 accepts a screw 14.

Figure 5:
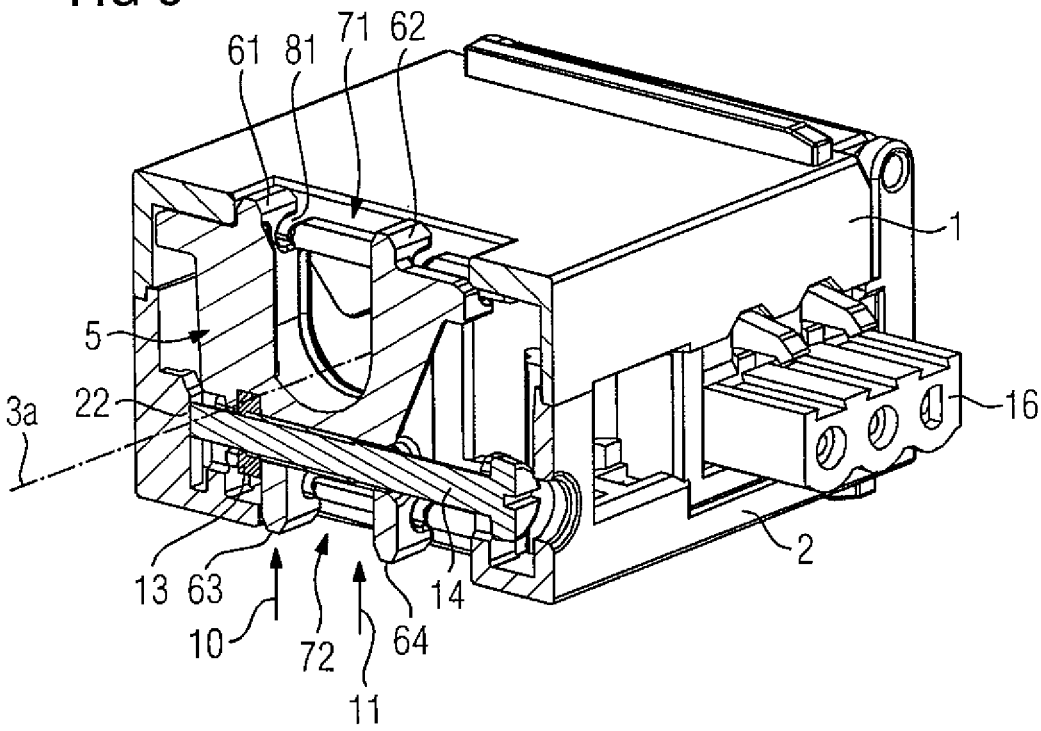
Figure 6:
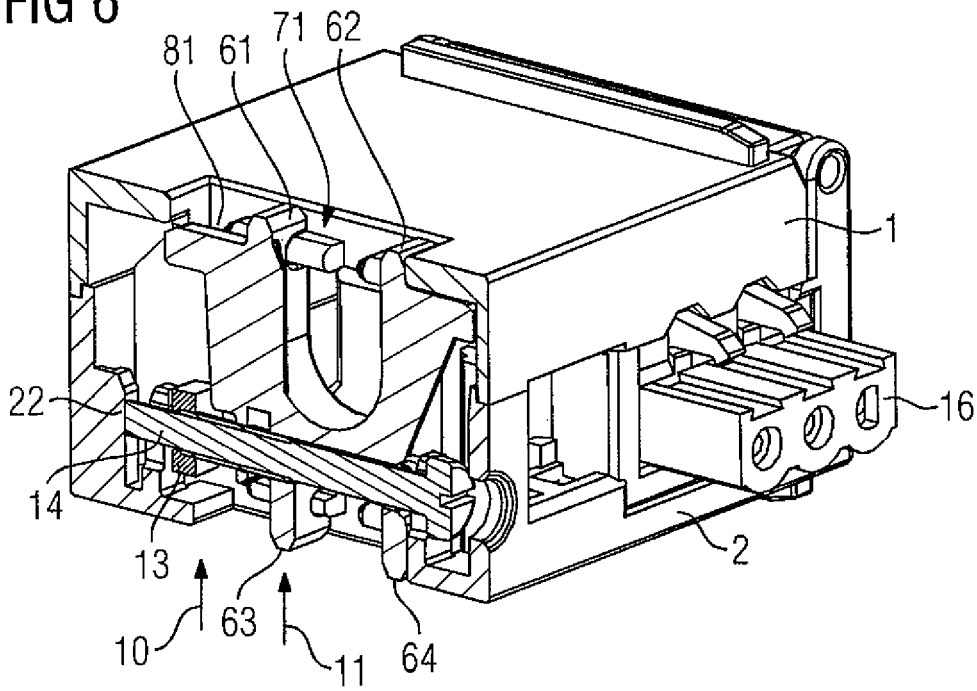

The method of operation of the movable strain relief device 5 is shown in the diagrams depicted in FIGS. 5 and 6. FIG. 5 is a sectional representation of the connecting plug with a section through the strain relief device 5 transverse to the longitudinal axis 3*a*, with the sectional diagram of FIG. 5 showing the strain relief device 5 in a first position 10 and FIG. 6 showing the strain relief device 5 in a second position 11. The strain relief device 5 is supported when the housing parts 1, 2 are folded together between the first and second housing part such that the strain relief device 5 is movable transversely to the longitudinal axis 3*a* of the entry channel 3.

In the first position 10, the T-shaped catches 61 to 64 project from the first longitudinal slot 71 or the second longitudinal slot 72 at recesses, such as the first recess 81 and the second recess 82. The screw 14 is passed through the strain relief device 5 and turned through the threaded section 13. Turning the screw 14 further in the clockwise direction causes the strain relief device 5 to move in the direction of the screw head, because the screw end encounters a resistance on an abutment 22 in the second housing part 2. Through continuous turning in the clockwise direction the strain relief device 5 thus moves from the first position 10 into the second position 11, during this operation the introduction cross-section of the entry channel 3 is continuously narrowing. At the same time, the T-shaped catches 61 to 64 move away from the corresponding recesses and slide onto ribs attached to the longitudinal slots 71 and 72, so that a separation of the housing parts 1 and 2 is no longer possible. The strain relief device 5 is now located in accordance with FIG. 6 in the second position 11. The T-shaped catches 61 to 64 likewise, moved into the second position 11, interact with the ribs in the longitudinal slots 71, 72 for the first housing part 1 to be locked to the second housing part 2.

Optionally, the connection plug can be configured such that it causes a perceptible latching when the first housing part 1 is closed onto the second housing part 2. For this purpose a latch-in opening 21 is disposed in the second housing part 2. The first housing part 1 accordingly has a further latching lug for latching into the latch-in opening 21. A further advantage that can be mentioned is that the installer experiences visual feedback that the two housing parts 1, 2 are locked to each other by the T-shaped catches 61 to 64 being visibly moved into the first longitudinal slot 71 and into the second longitudinal slot 72.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A line receptacle device, comprising:

a first housing part;

a second housing part;

a retaining device disposed in each of the first housing part and the second housing part;

an entry channel configured to receive a line; and a strain relief device movably arranged to move from a first position into a second position, and including a locking device, on transition of the strain relief device from the first position into the second position, the locking device interacts with the retaining device disposed in the first housing part and the second housing part such that the first and second housing parts are locked together;

wherein when the strain relief device is in the first position, the line is introducible through the entry channel and when the strain relief device is moved to the second position with the line in the entry channel, the line is clamped into the entry channel by the strain relief device.

2. The line receptacle device as claimed in claim 1, wherein the strain relief device includes a threaded section through which a screw is passed.

3. The line receptacle device as claimed in claim 1, wherein the strain relief device is formed in a U-shape.

4. The line receptacle device as claimed in claim 1, further comprising:

a receptacle configured to receive a plug connector.

5. The line receptacle device as claimed in claim 1, wherein the first housing part is pivotably connected to the second housing part to allow the first and second housing parts to be folded together into a housing.

6. The line receptacle device as claimed in claim 5, wherein, when the first and second housing parts are folded together, the strain relief device is supported between the first and second housing parts such that the strain relief device movable transversely to a longitudinal axis of the entry channel.

7. The line receptacle device as claimed in claim 1, wherein the locking device is formed as at least one T-shaped catch and the retaining device comprises longitudinal slots with recesses at the first position.

8. The line receptacle device as claimed in claim 5, wherein the locking device is formed as at least one T-shaped catch and the retaining device comprises longitudinal slots with recesses at the first position.

* * * * *